US006405507B1

(12) United States Patent
Milton et al.

(10) Patent No.: US 6,405,507 B1
(45) Date of Patent: Jun. 18, 2002

(54) CHANNEL MEMBERS

(76) Inventors: Edward "L" Milton, 635 Troy Ave., Idaho Falls, ID (US) 83402; Floyd Nelson Milton, 4386 S. Inverary Dr., #10, Holiday, UT (US) 84124

( * ) Notice: Subject to any disclaimer, the term of this patent is extended or adjusted under 35 U.S.C. 154(b) by 0 days.

(21) Appl. No.: 09/296,103

(22) Filed: Apr. 21, 1999

(51) Int. Cl.[7] ..... E04C 3/30
(52) U.S. Cl. ..... 52/731.4
(58) Field of Search ..... 52/275, 281, 284, 52/481.1, 731.4, 731.5, 731.7, 731.9, 730.7, 733.2, 737.2, 737.6, 664

(56) References Cited

U.S. PATENT DOCUMENTS

| | | | | | |
|---|---|---|---|---|---|
| 3,206,903 | A | * | 9/1965 | Johnson | 52/731.7 |
| 3,664,076 | A | * | 5/1972 | McCoy | 52/264 |
| 3,877,194 | A | * | 4/1975 | Matuschek et al. | 52/730 |
| 3,892,586 | A | | 7/1975 | Vladar et al. | |
| 4,279,112 | A | * | 7/1981 | Bertrand | 52/741 |
| 4,344,798 | A | | 8/1982 | Gaul et al. | |
| 4,665,666 | A | * | 5/1987 | Hampton | 52/86 |
| 4,852,310 | A | * | 8/1989 | Henley et al. | 52/90 |
| 5,210,990 | A | * | 5/1993 | Kirk, Jr. | 52/664 |
| 5,539,027 | A | * | 7/1996 | Deaner et al. | 52/309.7 |
| 5,945,182 | A | * | 8/1999 | Fowler et al. | 428/34 |
| 6,026,623 | A | | 2/2000 | Anderson | |
| 6,098,360 | A | * | 8/2000 | Johnson | 52/283 |
| 6,101,781 | A | * | 8/2000 | Balzer | 52/724.1 |

FOREIGN PATENT DOCUMENTS

| | | |
|---|---|---|
| FR | 911.104 | 6/1946 |
| FR | 911.321 | 7/1946 |

* cited by examiner

*Primary Examiner*—Curtis A. Cohen
(74) *Attorney, Agent, or Firm*—Workman, Nydegger & Seeley

(57) ABSTRACT

A channel member includes an elongated backboard having a front face and an opposing back face each extending between a first side face and an opposing second side face. An elongated first rail has a front face extending between a first side face and an opposing second side face. The first side face of the first rail is secured against the front face of the backboard so as to orthogonally project adjacent to the first side face of the backboard. An elongated second rail has a front face extending between a first side face and an opposing second side face. The first side face of the second rail is secured against the front face of the backboard so as to orthogonally project therefrom adjacent to the second side face of the backboard. The backboard, first rail, and second rail are comprised of wafer board. In an alternative embodiment, the channel member is integrally molded as a discrete unit from a composition of organic non-wood fibers and resin.

10 Claims, 11 Drawing Sheets

CHANNEL MEMBERS

BACKGROUND OF THE INVENTION

1. The Field of the Invention

The present invention relates generally to structural building materials and, more specifically, wall channels which-are-typically used as backing for wallboard.

2. The Relevant Technology

The prevalent residential construction technique utilized currently in the United States employs structural members, more commonly referred to as boards, which are milled from trees. The boards can be milled from trees that are indigenous to the region or transported to the region. For example, douglas fir is often used for residential construction in the west whereas hemlock-and-other woods are used in other regions of the United States. In applications where weather resistance and rot resistance is necessitated, redwood from the west coast may be transported for use in those applications.

Conventional, residential framing techniques utilize 2×4 or 2×6 boards in wall construction. As depicted in FIG. 1, a framed wall 10 typically comprises a horizontally disposed top plate 12, a horizontally disposed bottom plate 14 and a plurality of vertically oriented studs 16 that extend between plates 12 and 14. Studs 16 are usually spaced apart either, 16 inches or 24 inches on center. Studs 16 are typically held in place by nailing through the top and bottom plates 12 and 14 into studs 16. This regular pattern of studs 16 is interrupted by door and window openings and by the need to tie into interior or partition walls and to create corners for intersections with other exterior walls.

At the point of intersection between an interior wall or two exterior walls, a special channel member needs to be assembled. For example, depicted in FIG. 1, a substantially U-shaped channel member 18 is position at the intersection of wall 10 with a second wall 17. In a conventional wall made of 2×4's, channel member 18 is created by assembling three 2×4 studs. As depicted in FIG. 2, channel member 18 comprises a pair of side studs 20 and 22 and a center stud 24 extending therebetween. As depicted in FIG. 3, side stud 20 comprises a front face 26, an opposing back face 27, and opposing side faces 28, 29; side stud 22 comprises a front face 30, a back face 31, and opposing side faces 32, 33; and center stud 24 comprises a front face 34, an opposing back face 35 and opposing side faces 36,37.

During assembly, side face 37 of center stud 24 is biased against front face 26 of side stud 20 adjacent side face 28. In this position, nails are driven through back face 27 of side stud 20 into center stud 24, thereby securing studs 20 and 24 together at right angles. Similarly, side face 36 of center stud 24 is biased against front face 30 of side stud 22 adjacent to side face 32. In this position, nails are driven through back face 31 of side stud 22 and into center stud 24, thereby securing studs 22 and 24 together at right angles.

Returning to FIGS. 1 and 2, the resulting channel member 18 has thickness T equal to the width of a conventional stud and a width W that is greater than the width of a conventional stud. During use of channel member 18 in a corner configuration, channel member 18 is positioned at the end of wall 10 such that back face 35 of center stud 24 faces intersecting wall 17. The opposing ends of channel member 18 are secured to and covered by plates 12 and 14. Intersecting wall 17 in then secured to wall 10 by positioning a stud 40 of wall 17 against back face 35 of center stud 24 and nailing the two together. As a result of channel member 18 having a width W greater than the width of stud 40, an exposed inside corner 42 is formed at the juncture of channel member 18 and stud 40. Inside corner 42 is useful in that it forms a backing surface on which wallboard can be nailed during mounting on both wall 10 and wall 17. Specifically, the wallboard can be nailed to an exposed side face 39 of stud 40 and exposed side face 28 of side stud 20.

Although conventional channel members 18 are useful, they have several drawbacks. For example, conventional channel members 18 are nailed together at a construction site out of available 2×4 studs. During the assemblage of the studs, some lumber is wasted because it chips and cracks when the pieces are nailed together or the sections can be improperly aligned at their ends so that they are not flush, thereby making the assemblage unusable. Furthermore, the 2×4's are often warped or become warped under environmental conditions such as high heat or exposure to water. The manufacture of channel member 18 out of warped boards or the subsequent warping of the assembled channel member makes it difficult to insure that the corresponding wall is straight and plum. Furthermore, the warped channel member can provide an irregular surface to which the wallboard is attached. As a result, the exposed wallboard on the finished wall can have an irregular appearance.

An additional problem with conventional channel members 18 is that they have a fixed structural strength. That is, using conventional 2×4's, channel member 18 can only be assembled in one configuration having fixed structural properties. In most situation, the use of three 2×4's produces a channel member that exceeds desired strength requirement, thereby resulting in an excess use of wood. In other occasions, however, particularly where the walls are exposed to heavy loads, channel member 18 can have insufficient strength.

Finally, as a result of the increased expense and decreased availability of lumber, there is a need for manufacturing inexpensive channel members that minimize the depletion of available lumber supplies.

OBJECTS AND BRIEF SUMMARY THE INVENTION

Accordingly, it is an object of the present invention to provide improved channel members for use in framing buildings.

Another object of the present invention is to provide improved channel members wherein neither the channel members nor the discrete elements thereof warp.

Also an object of the present invention is to provide channel members as above wherein the channel members have an improved design to resist buckling, bending, and warping in an assembled condition.

Yet another object of the present invention is to provide channel members as above that can be engineered and selectively designed to meet desired code and/or strength requirements.

Another object of the present invention is to provide channel members that can be easily and inexpensively mass produced to exacting tolerances.

Finally, another object of the present invention is to provide channel members that minimize the required use of lumber and wood material.

In order to achieve the forgoing and other objectives, in one embodiment a channel member is provided having an elongated backboard with a front face and an opposing back face each extending between a first side face and an opposing second side face. An elongated first rail has a front face extending between a first side face and an opposing second side face. The first side face of the first rail is secured against the front face of the backboard so as to orthogonally project adjacent to the first side face of the backboard. An elongated second rail has a front face extending between a first side face and an opposing second side face. The first side face of the second rail is secured against the front face of the backboard so as to orthogonally project therefrom adjacent to the second side face of the backboard. The backboard, first rail, and second rail are discrete elements comprised of wafer board. The assembled channel member has a substantially U-shaped transverse cross section with a width greater than the width of a 2×4 stud or other framing member the channel member is to bet used with. The channel member also has a thickness that is substantially equal to the width of a 2×4 stud or other framing member the channel member is to be used with.

In an alternative embodiment, a channel member is provided wherein the channel member is molded as an integral discrete unit. This channel member also has a substantially U-shaped transverse cross section and has a width and thickness comparable to the channel member discussed above. In contrast to the above channel member wherein the front faces of the opposing rails are disposed in substantially parallel planes, the interior faces of the rails on the molded channel inwardly slope to a converging apex. The molded channel is comprised of a mixture of organic, non-wood fibers, such as straw from wheat or oat, and a resin such as isocyanate.

The inventive channel members can be used in substantially the same way as conventional channel members but have several distinct advantages. For example, the inventive channel members can be engineered to specifically meet code and design requirements. That is, the thickness and width of the discrete members or the configuration of the mold can be selectively altered to produce channel members having desired strength properties without changing the overall thickness and width of the channel member. As a result, the channel members can be formed that have minimal material cost and optimal strength. Manufacturing the channel members out of wafer board or the inventive composition further insures that channel members will not warp or bend under a variety of different environmental conditions. As a result, the inventive channel members insure that the corresponding wall is straight and plum and insures that a flat surface is provided for securing the wallboard thereto. Furthermore, manufacturing the channel member out of the inventive organic fiber composition minimizes the use of lumber or wood product and significantly decreases the cost of the product.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawing depict only a typical embodiment of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Figure 1:
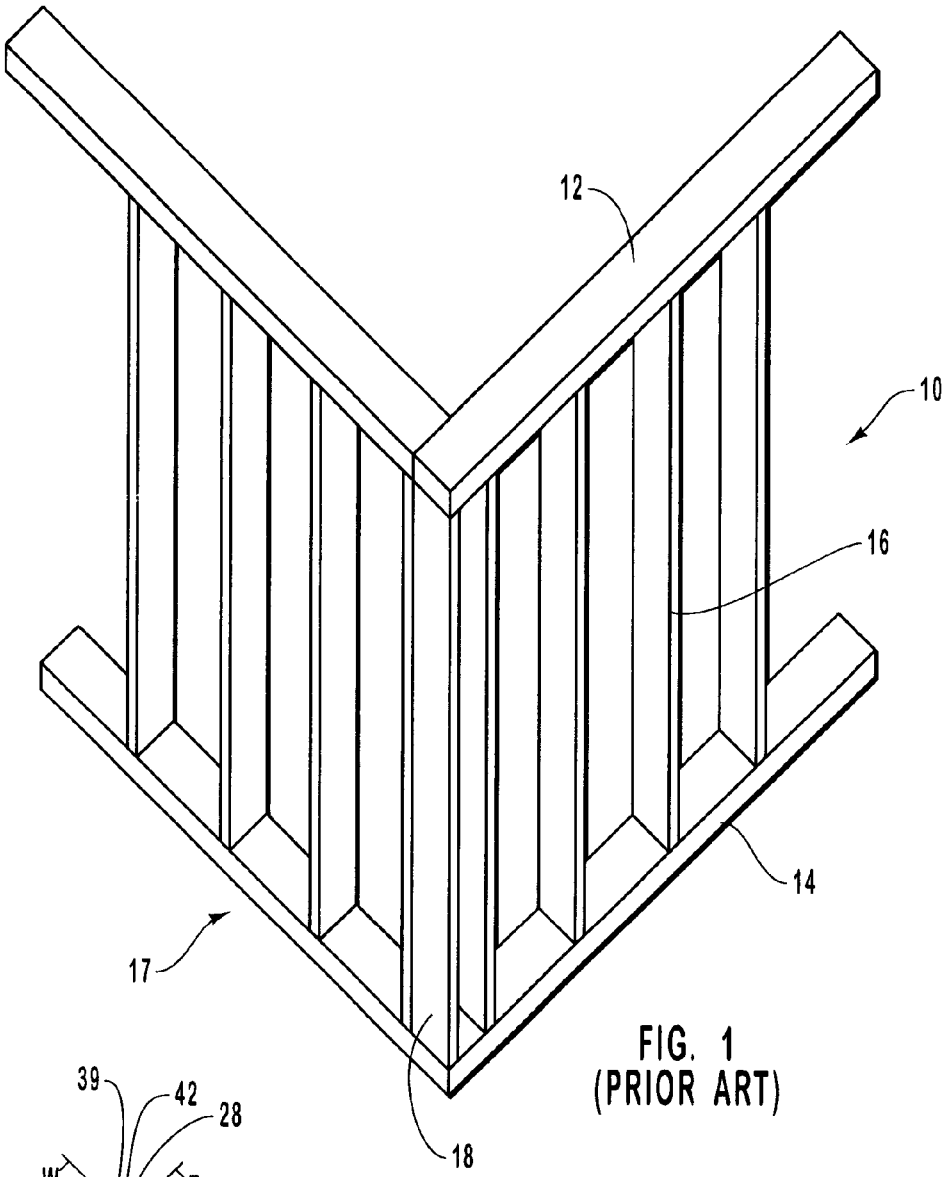
FIG. 1 (PRIOR ART)
FIG. 1 is a perspective view of two walls intersecting at a corner where a prior art channel member is disposed.
Figure 2:
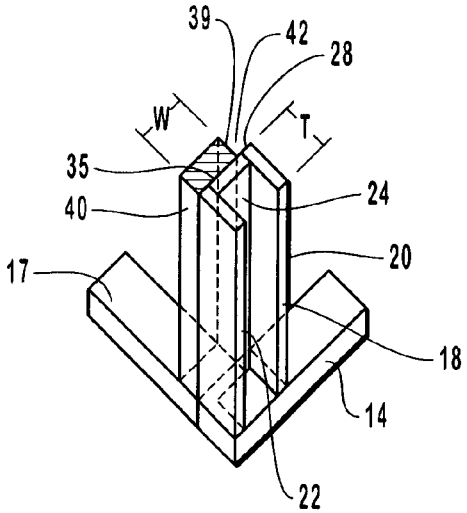
FIG. 2 (PRIOR ART)
FIG. 2 is a partially cutaway perspective view of the channel member shown in FIG. 1.
Figure 3:
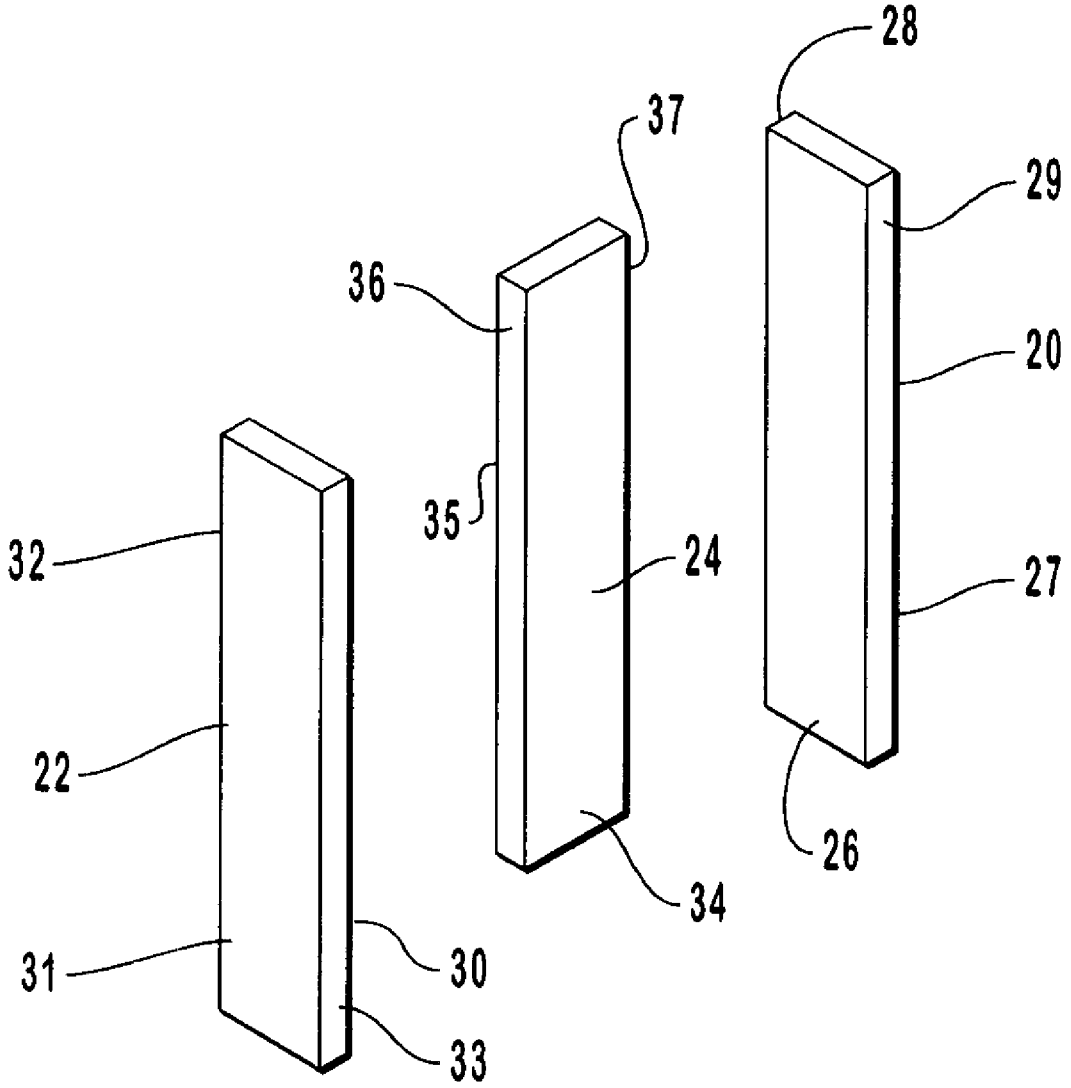
FIG. 3 (PRIOR ART)
FIG. 3 is a perspective view of the channel member show in FIG. 2 in a disassembled condition.
Figure 4:
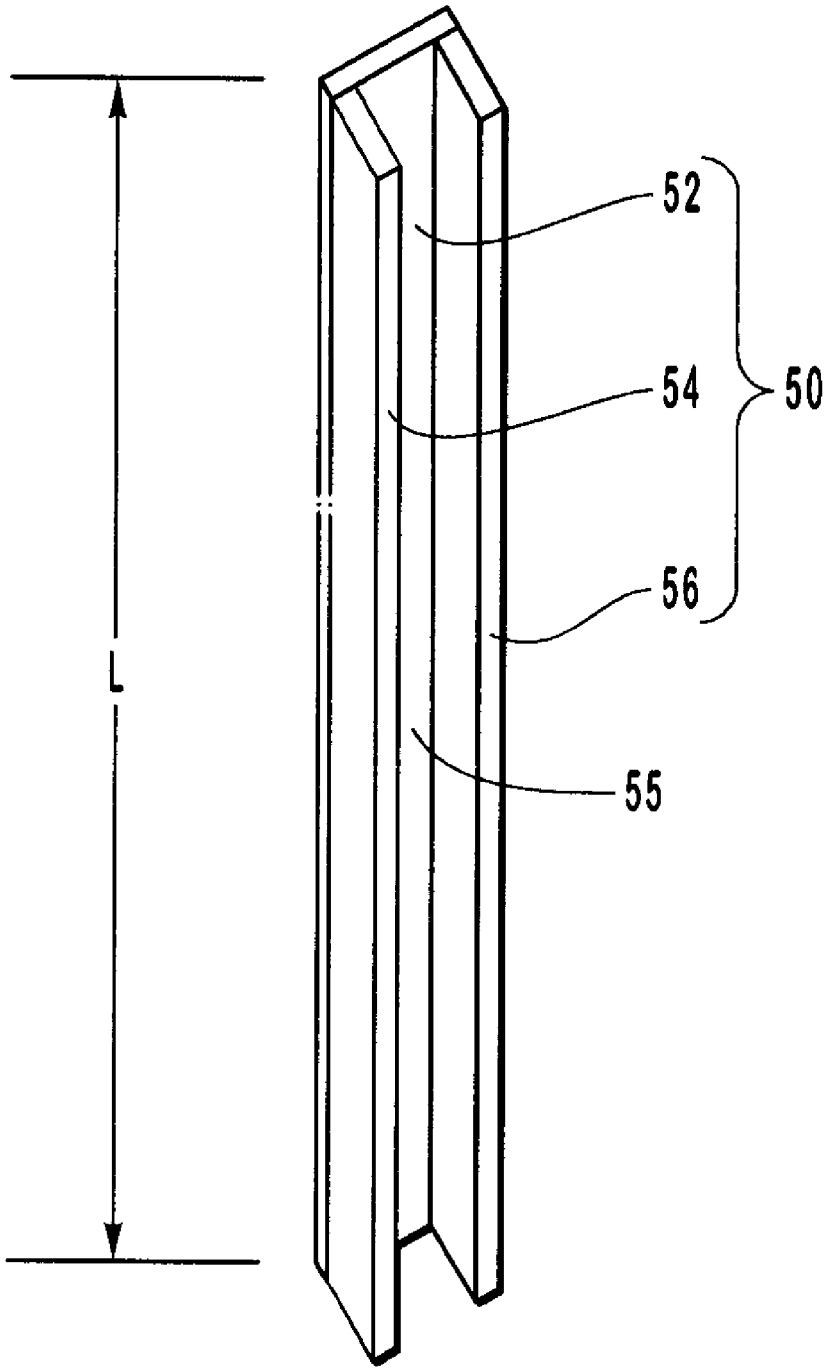
FIG. 4 is a perspective view of an inventive channel member.

The present invention relates to prefabricated channel members that can be used to replace conventional channel members that are typically assembled on a construction site. Depicted in FIG. 4 is one embodiment of an inventive channel member 50 incorporating features of the present invention. Channel member 50 has a substantially C-shaped transverse cross section and is comprised of a backboard 52 having a first rail 54 and a spaced apart second rail 56 projecting therefrom. Backboard 52 and rails 54 and 56 bound a channel 55 that extends along the length of channel member 50. Channel member 50 has a length L in a range between about 84 inches to about 144 inches with about 92 inches to about 120 inches being more preferred.

Figure 5:
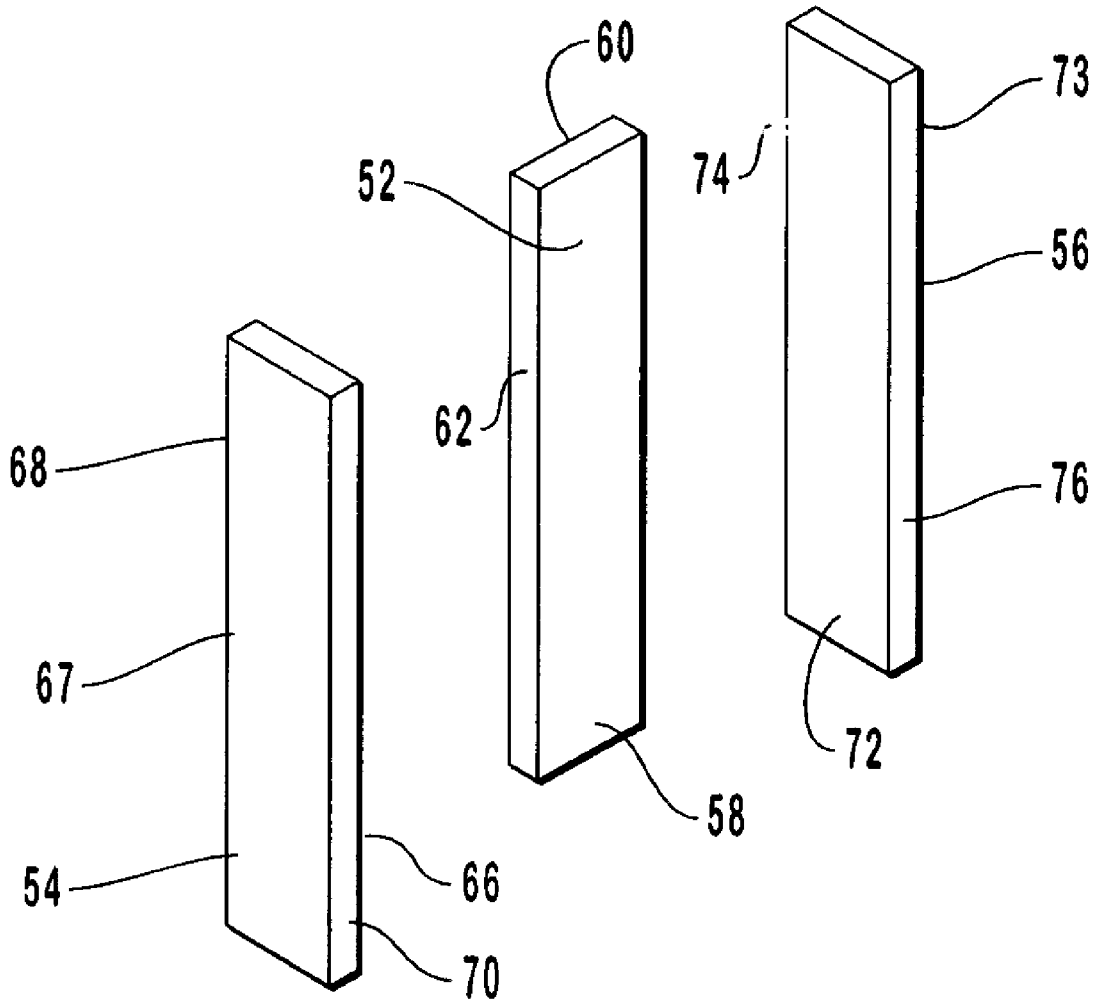
FIG. 5 a perspective view of the channel member show in FIG. 4 in a disassembled condition.

As depicted in FIG. 5, backboard 52 and rails 54 and 56 comprise three discrete elements that are connected together. Backboard 52 has a front face 58 and an opposing back face 60 both of which extend between opposing side faces 62 and 64. First rail 54 likewise has a front face 66, an opposing back face 67, and opposing side faces 68 and 70. Similarly, second rail 56 has a front face 72, a back face 73, and opposing side faces 74 and 76.

During assembly, side face 68 of first rail 54 is biased against front face 58 of backboard 52 so as to orthogonally project adjacent to side face 62 of backboard 52. The present invention includes means for securing first rail 54 to backboard 52. By way of example and not by limitation, nails, screws, staples, and the like can be passed through back face 60 of backboard 52 and into first rail 54, thereby securing first rail 54 to backboard 52 in the substantially orthogonal position. In alternative embodiments, adhesives can be used either independently or in conjunction with the above structures to secure first rail 54 to backboard 52. The present invention also envisions that first rail 54 and backboard 52 can be secured together by an interlocking joint. For example, a dovetail joint can be provided by forming complementary mortises and tenons along side face 68 of first rail 54 and side face 62 of backboard 52.

Side face 74 of second rail 56 is biased against front face 58 of backboard 52 so as to orthogonally project adjacent to side face 64 thereof. Means are also provided for securing second rail 56 to backboard 52. This means for securing includes the same means as previously discussed with regard to securing first rail 54 to backboard 52. For example, nails, screws, staples, and the like can be passed through back face 60 of backboard 52 and into second rail 56, thereby securing rail 56 to backboard 52 in the substantially orthogonal position.

Figure 6:
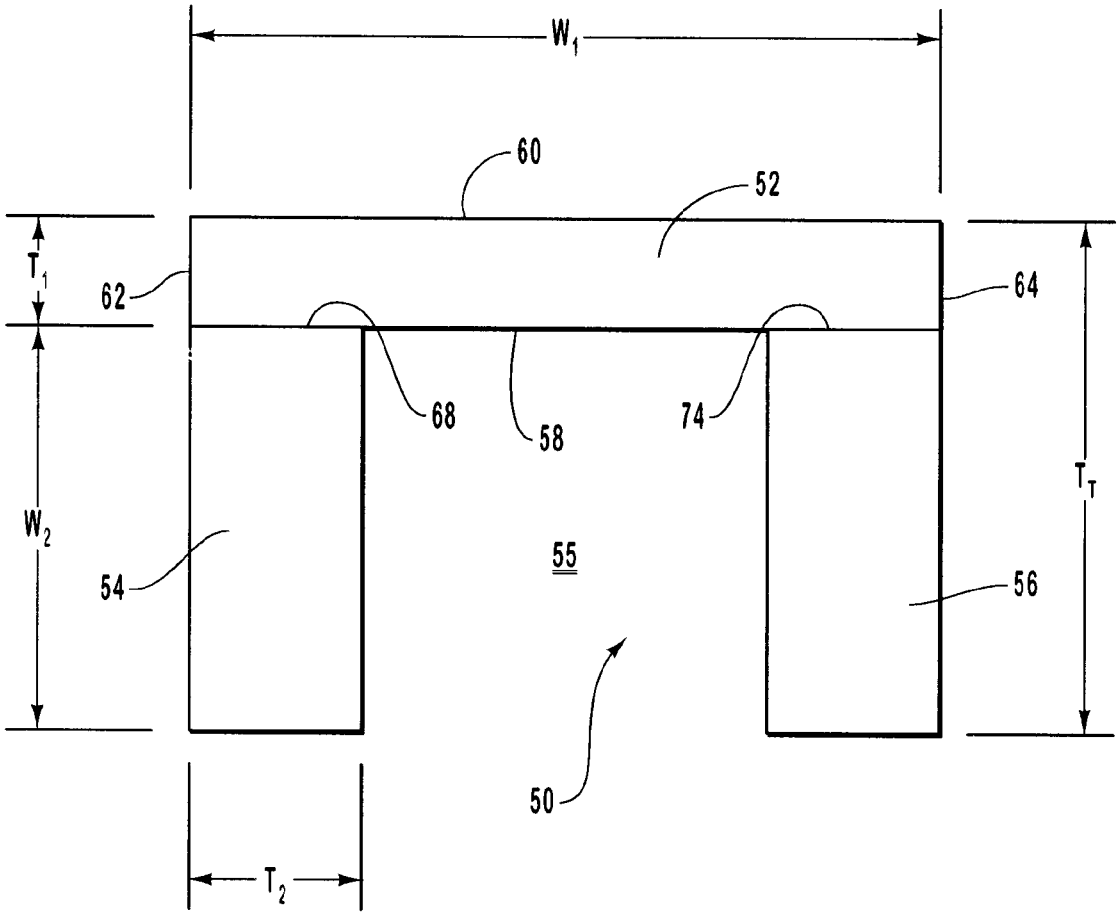
FIG. 6 is a top view of the channel member shown in FIG. 4.

Channel member 50 preferably comes in two sizes but can be made to any desired dimensions. One conventional size is for use where framing is being done with 2×4's and the other conventional size is where framing is being done with 2×6's. As depicted in FIG. 6, where 2×4 framing is being used, backboard 52 has a width $W_1$ in a range between about 5 inches to about 7 inches, with about 5 inches being more preferred, and a thickness $T_1$ in a range between about ¾ inches to about 1⅛ inches, with about ¾ inches being more preferred. Each rail 54 and 56 has a width $W_2$ in a range between about 2¾ inches to about 3½ inches, with about 2¾ inches being more preferred, and a thickness $T_2$ in a range between about 1⅛ inches to about 1½ inches, with about 1⅛ inches being more preferred. The total thickness $T_T$ of channel member 50 is typically in a range between about 3¼ inches to about 3¾ inches with about 3½ inches being more preferred. In the preferred embodiment, the total thickness $T_T$ of channel member 50 is substantially the same as the width of a 2×4 or other size framing member. This allows channel member 50 to be easily secured between the top and bottom plates of a wall member without projecting beyond the sides thereof.

Where 2×6 framing is being used, backboard 52 has a width $W_1$ in a range between about 7 inches to about 9 inches, with about 8½ inches being more preferred, and a thickness $T_1$ in a range between about ¾ inches to about 1⅛ inches, with about ¾ inches being more preferred. Each rail 54 and 56 has a width $W_2$ in a range between about 4¾ inches to about 6 inches, with about 4¾ inches being more preferred, and a thickness $T_2$ in a range between about 1⅛ inches to about 1½ inches, with about 1⅛ inches being more preferred. The total thickness $T_T$ of channel member 50 is typically in a range between about 5¼ inches to about 5¾ inches with about 5½ inches being more preferred.

Channel member 50 can be made from any desired material such as conventional lumber laminates, synthetics, or other engineered products. In one embodiment, however, channel member 50 is comprised of wafer board also referred to as OSB. Wafer board has several unique benefits in that it can be purchased off the shelf in different thicknesses, has relatively high strengths, can be securely nailed through at any orientation, does not warp, is somewhat water resistant, and does not warp when exposed to wide temperature swings or variance in climatic conditions. As a result, by using wafer board, the discrete members 52, 54, and 56 can be cut to exacting tolerances and then secured together to produce channel members 50 meeting desired standards and parameters. The members 52, 54, and 56 can be cut and secured together in a single mass production, prefabrication facility. Channel members 50 can be made or cut to a desired length and then shipped either to a retail outlet or directly to a construction site.

As a result of the configuration, composition, and attachment of discrete members 52, 54, and 56, channel member 50 has significant advantages over the prior art channel members. For example, channel member 50 has rails 54 and 56 projecting from front face 58 of backboard 52. This is in contrast to the prior art where the corresponding side studs are attached to the side faces of the center stud. As a result, backboard 53, and thus channel member 50, has a greater width than center stud 24 on channel member 18. Increasing the width of backboard 52 is comparable to increasing the width of the web on an I-beam. That is, channel member 50 has an increased lateral rigidity with resistance to torsional or moment arm bending. As a result, channel member 50 has increased strength to prevent buckling, bending, and warping. Since channel member 18 is made of conventional 2×4's or 2×6's, conventional channel member 18 cannot be configured in the same design as channel member 50 without the extra effort and cost of cutting down standard boards. That is, securing conventional 2×4's on the face of a 2×4 would produce a channel member that is too thick for securing between the top and bottom 2×4 plates of a wall and is insufficiently wide to produce the required inside comer at a wall juncture for the attachment of wallboard.

Another benefit of the inventive channel member 50 is that it can be engineered to specifically meet code and design requirements. That is, the thickness and width of the discrete members can be selectively altered to produce a channel member having desired strength properties without changing the overall thickness and width of the channel member. As a result, channel members 50 can be formed that have minimal material cost and optimal strength. Manufacturing channel members 50 out of wafer board further insures that channel members 50 will not warp or bend under a variety of different environmental conditions. As a result, channel members 50 help insure that the corresponding wall is straight and plum and insures that a flat surface is provided for securing the wallboard thereto.

Figure 7:
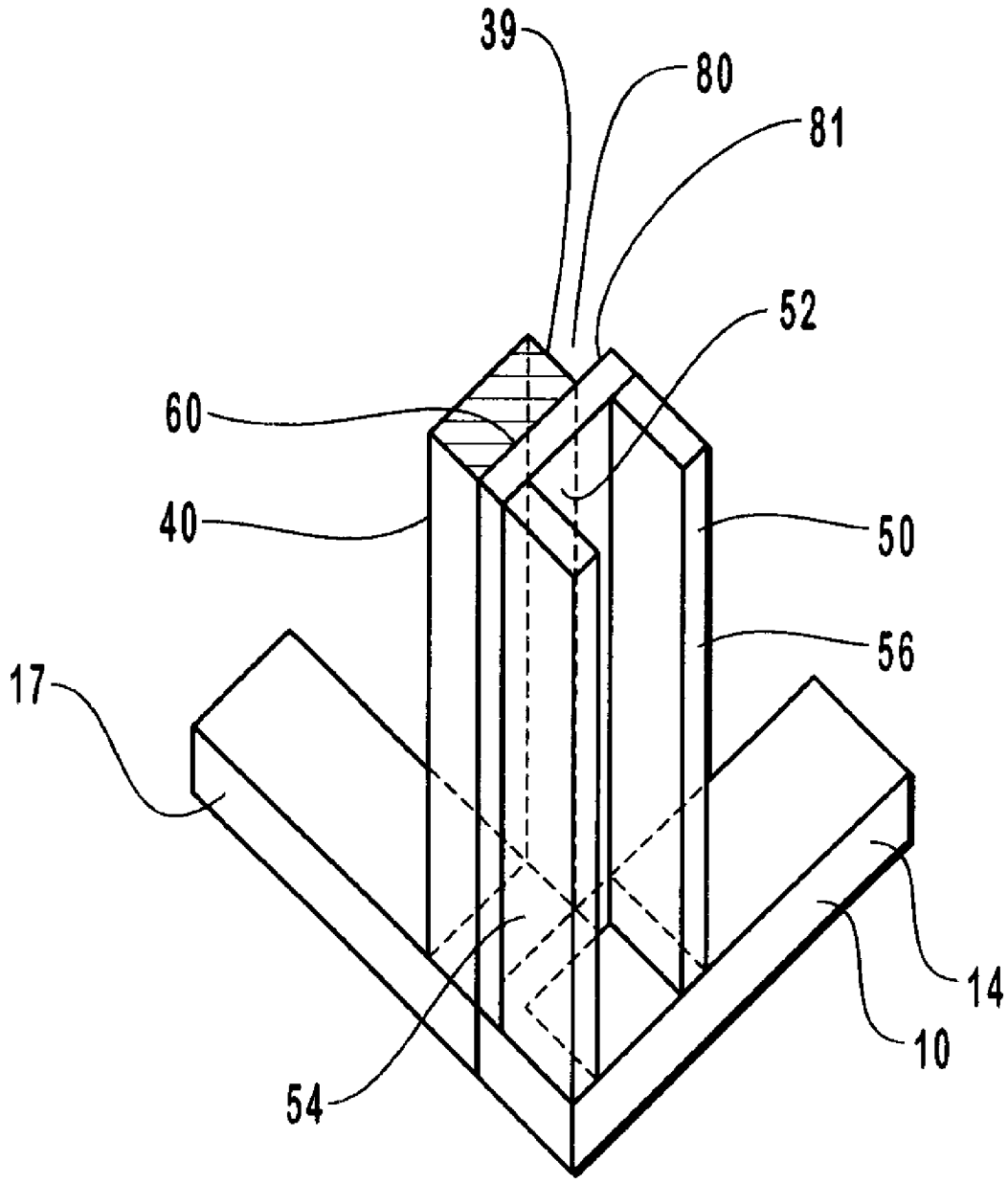
FIG. 7 is a partially cutaway perspective view of the channel member shown in FIG. 4 positioned at the intersecting corner of two walls.

Channel member 50 can be used in substantially the same way as conventional channel member 18. For example, depicted in FIG. 7, during use of channel member 50 in a comer configuration, channel member 50 is positioned at the end of wall 10 such that back face 60 of backboard 52 faces intersecting wall 17. The opposing ends of channel member 50 are secured to and covered by plates 12 and 14. Intersecting wall 17 in then secured to wall 10 by positioning stud 40 of wall 17 against back face 60 of backboard 52 and nailing or otherwise securing the two together. As a result of channel member 50 having a width $W_1$ greater than the width of stud 40, an exposed inside corner 80 is formed at the juncture of channel member 50 and stud 40. Inside comer 80 is used as a backing surface on which wallboard can be secured during mounting on both wall 10 and wall 17. Specifically, the wallboard can be nailed or screwed to the exposed side face 39 of stud 40 and to an exposed portion 81 of back face 60 of backboard 52.

Figure 8:
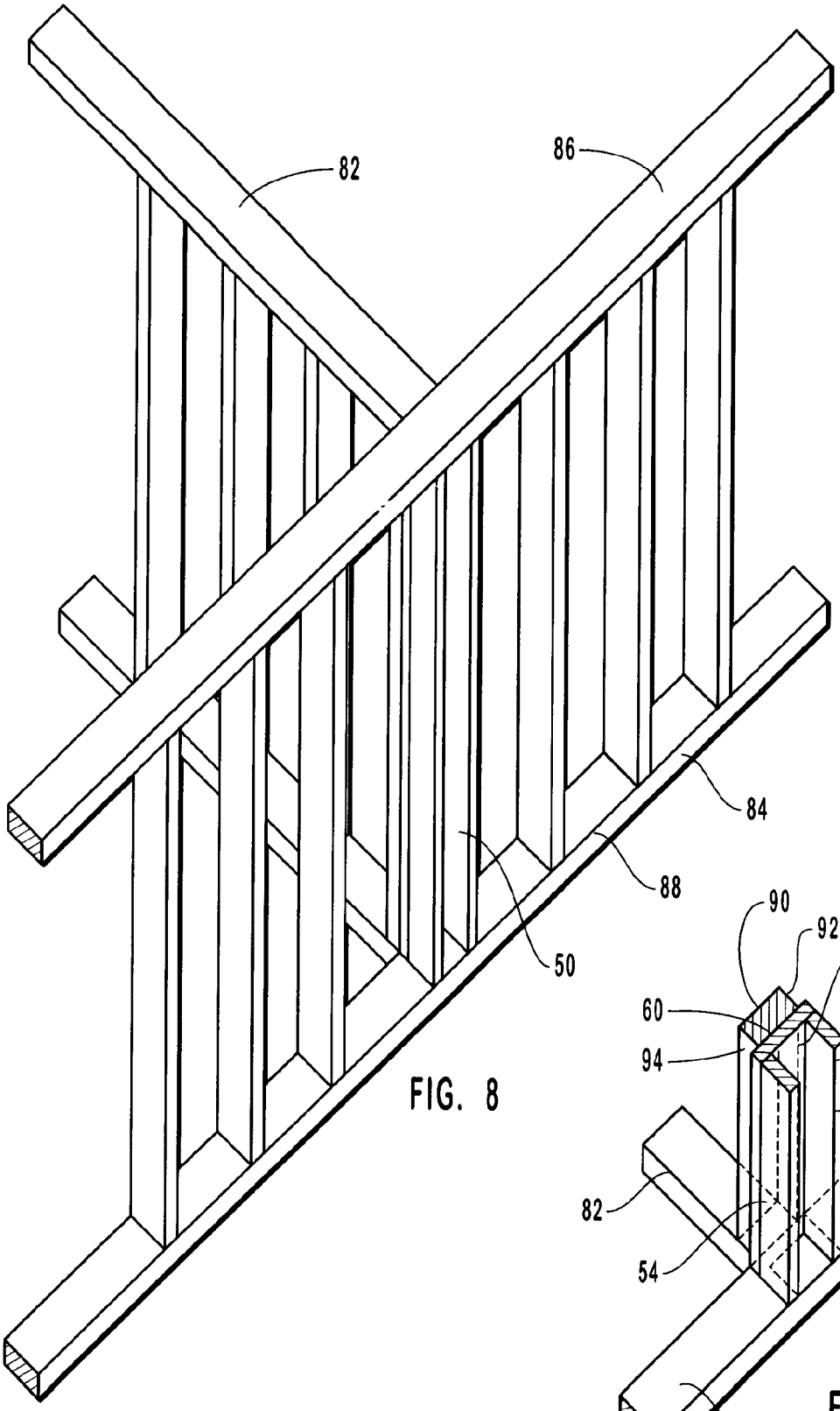
FIG. 8 is a perspective view of the channel member shown in FIG. 4 connecting an interior wall to exterior wall.
Figure 9:
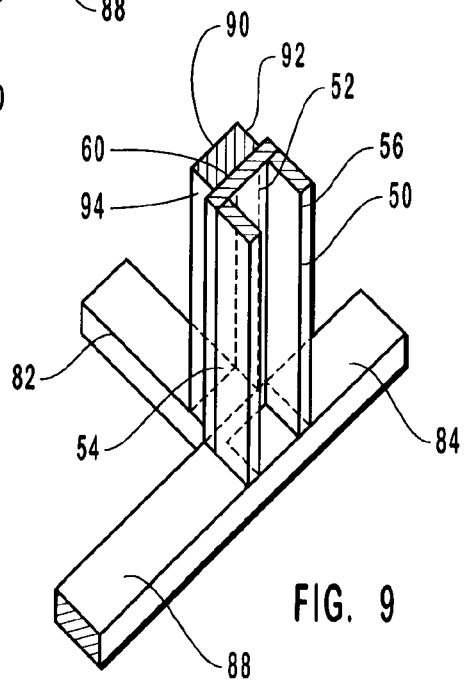
FIG. 9 is a partially cutaway perspective view of the channel member shown in FIG. 8.

Turning now to FIGS. 8 and 9, channel member 50 can also be used where an interior wall or partition 82 is centrally intersects an exterior or interior wall 84. Channel member 50 is secured between a top plate 86 and a bottom plate 88 so that back face 60 of backboard 52 faces interior wall 82. A stud 90 of interior wall 82 aligned with and centrally secured to back face 60 of backboard 52. In this configuration, as depicted in FIG. 9, inside comers 92 and 94 are formed where the opposing sides of stud 90 intersect back face 60 of backboard 52. Inside corners 92 and 94 provide backing surfaces for securing wallboard along each side of interior wall 82 and along the length of exterior wall 84.

Figure 10:
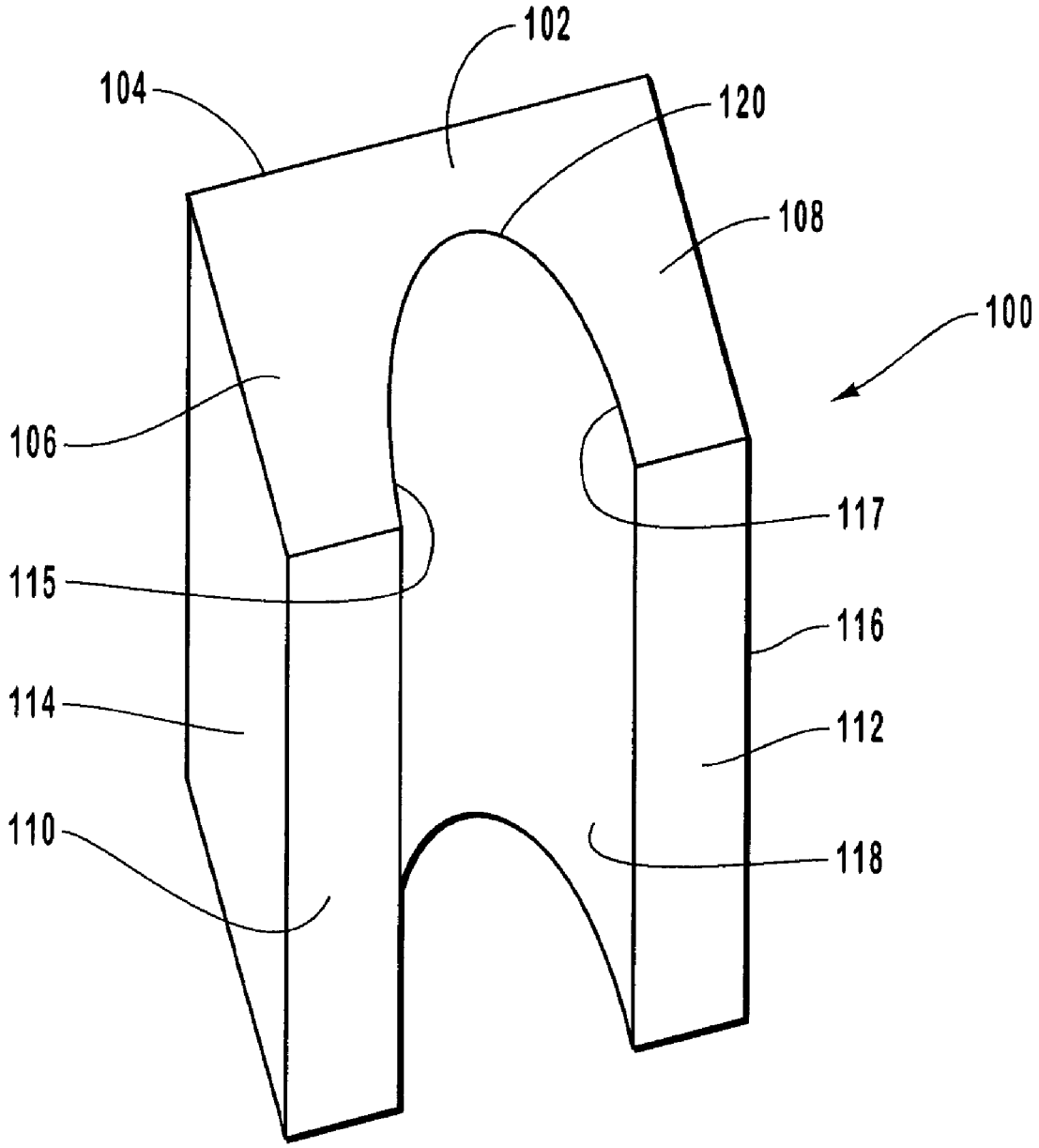
FIG. 10 is a perspective view of an alternative embodiment of an inventive channel member.

Depicted in FIG. 10, the present invention also envisions methods for manufacturing an inventive channel member 100 out of a mixture of resin and organic non-wood or wood fibers. Channel member 100 has an elongated back wall 102 with a substantially flat back face 104 formed thereon. Orthogonally projecting along the length of corresponding sides of back wall 102 is a first rail 106 and a spaced apart second rail 108. Rails 106 and 108 each terminate in a corresponding substantially flat front face 110, 112. Front faces 110 and 112 are each substantially parallel with back face 104. First rail 106 also includes a planer exterior face 114 and an interior face 115. Similarly, second rail 108 includes a substantially planer exterior face 116 and an interior face 117. Exterior faces 114 and 116 are each disposed in substantially parallel planes and orthogonally intersect with back face 104. Extending between first rail 106 and second rail 108 is an elongated substantially U-shaped curved channel 118 which may vary as overall size changes. That is, interior faces 115 and 117 are sloped relative to their corresponding exterior face so as to intersect at an apex 120. Accordingly, the thickness of rails 106 and 108 increases from corresponding front faces 110, 112 to apex 120 of curved channel 118. Expressed in other terms, each of rails 106 and 108 has a substantially wedged shaped transverse cross section. The dimensions of channel member 100 are substantially the same as those previously discussed with regard to channel member 50. As discussed below, channel member 100 is molded as a discrete integral unit.

Channel member 100 can be formed from a variety of different fibers and combination of fibers. In one embodiment of the present invention, the fiber is organic non-wood fibers such as straw fibers from wheat, oat, and barley; corn stalk; alfalfa hay; and the like. In alternative embodiment, synthetic fibers, fiberglass fibers, and other inorganic fibers along with wood fibers can be used independently or in conjunction with the organic non-wood fibers. The present invention also envisions that conventional fillers such as sand and foam beads can also be added. The benefit of using organic non-wood fibers is that they are inexpensive, often otherwise unusable, are annually renewable, and reduce the pressure on forests and timber resources. It will be appreciated by those skilled in the art that the method set forth below may need to be varied depending on the type of fibers utilized.

Figure 11:
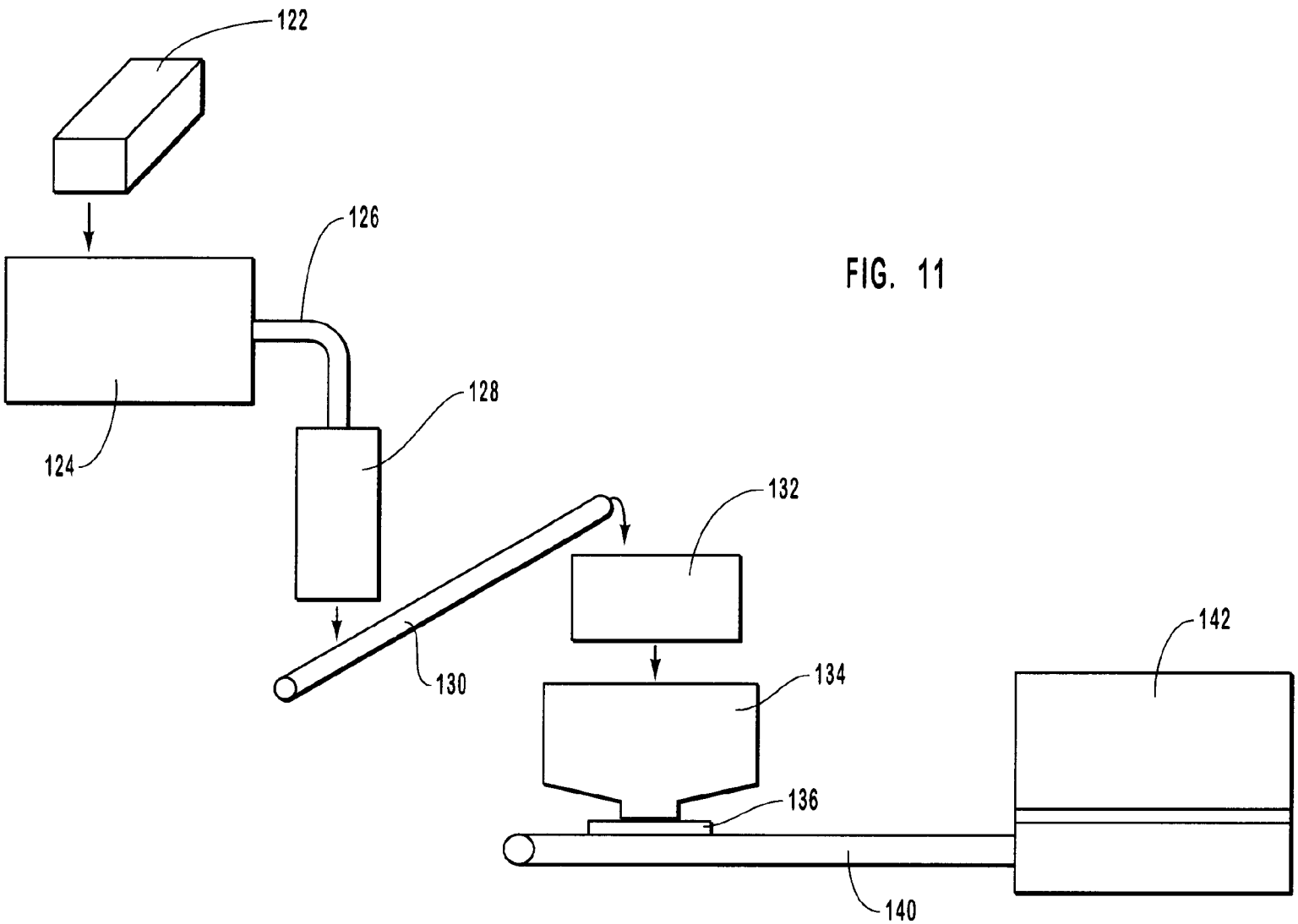
FIG. 11 is a schematic representation of a manufacturing system for use in manufacturing the channel member shown in FIG. 10.

As depicted in FIG. 11, the fiber, such as wheat straw, is generally packed in fiber bales 122 which are broken apart and processed in a hammer mill 124 to split the stocks and break the fibers into various lengths. To improve the structural integrity of channel member 100, the fiber lengths are random. Typical fiber lengths varying from about 0.5 inches to about 1 foot. It will be appreciated that the structural integrity of channel member 100 may be varied by mixing the organic fibers with other fibers (organic and inorganic) and by varying the length of the fibers.

The fibers then travel through a conduit 126 to a storage hopper 128 where the fibers are dried. The fibers are dried by circulating hot air through the fibers. The fibers are next transported by a conveyor belt 130 from storage hopper 128 to a weighing hopper 132. Once a sufficient weight of fibers are collected, the fibers are passed into a mixing drum 134. Within mixing drum 134, the fibers are thoroughly mixed with a resin to form a mixture. The resin can be sprayed or otherwise added to the fibers within mixing drum 134. Examples of available resins include isocyanate (MDI), light gluten foam glue, and uria formaldehyde. Other resins that are able to bond with organic non-wood fibers can also be used. Such resins, however, are limited in that there are few resins that bond with organic non-wood fibers which typically contain silica.

The resin is typically added in a volume percent ratio in a range between about 30% to about 2%, with about 15% to about 2% being preferred, and about 7% to about 2% being more preferred. The fiber is typically added in a volume percent ratio in a range between about 60% to about 98%, with about 85% to about 98% being preferred, and about 93% to about 98% being more preferred.

Once the mixture is formed, the mixture is evenly distributed within a mold 136. Mold 136 is carried to a press 142 by a conveyor belt 140. In an alternative method of manufacture, the dried fibers travel along a conveyor belt and fall upon a table bearing a mold. As the fibers fall off of the conveyor belt onto the moving mold, the fibers are sprayed with a resin through a spray bar. The table beneath the end of the conveyor belt moves back and forth so as to spread the fibers evenly to form a resin coated mat of fibers. The depth of the mat will need to be varied depending on the fibers utilized. In one embodiment, the mat depth is between about 6 inches and about 9 inches. Once a mat of sufficient depth has been reached, the mold is slid off of the moving table and over to press 142.

Figure 12:
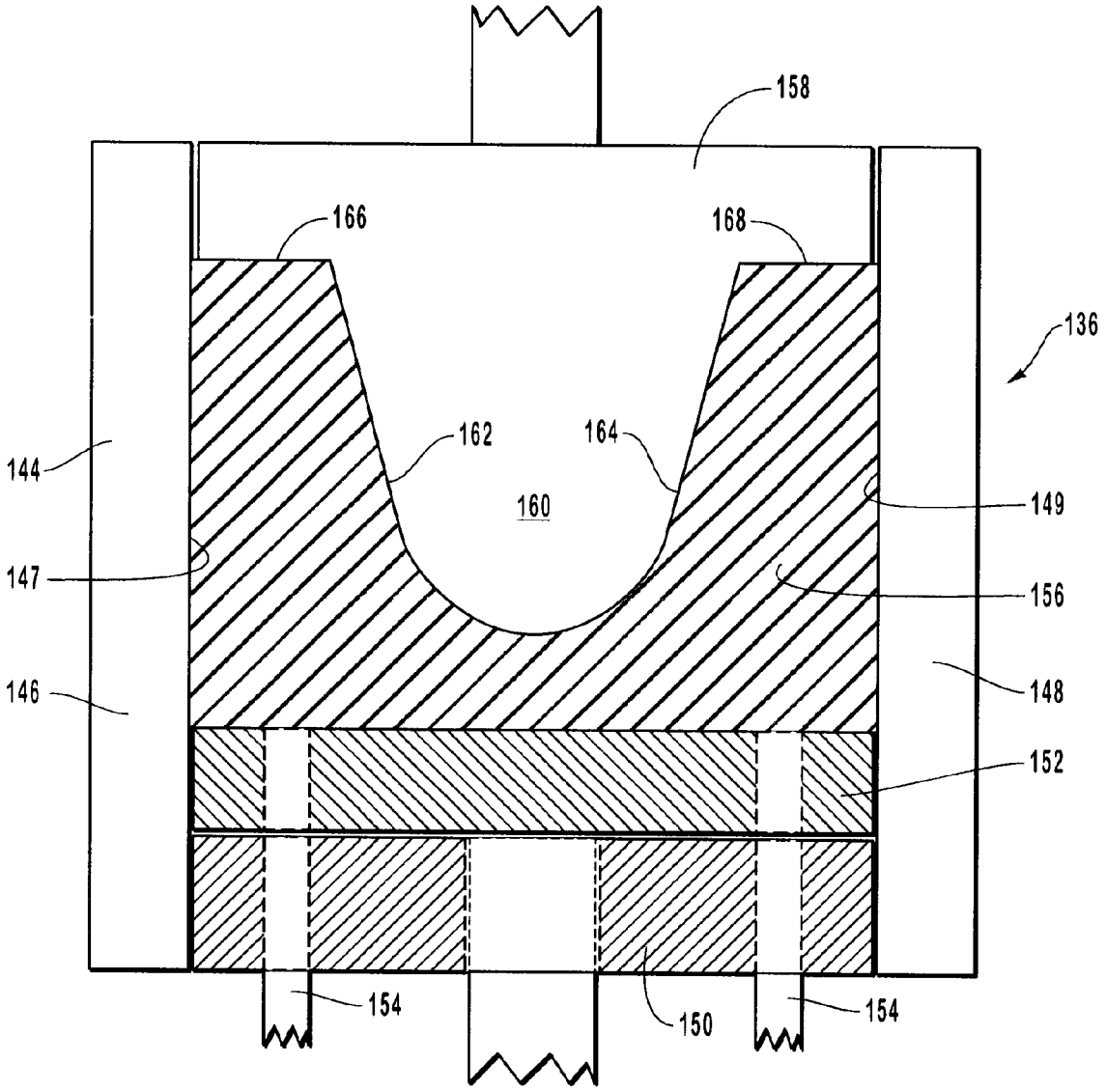
FIG. 12 is a cross sectional side view of a mold used in manufacturing the channel member shown in FIG. 10.

As depicted in FIG. 12, mold 136 includes a substantially rectangular frame 144 which includes a side wall 146 having an inside face 147 and an opposing side wall 148 having an inside face 149. Inside faces 147 and 149 are disposed in substantially parallel planes. Positioned at the bottom of mold 136 is a base 150 on which an ejection plate 152 is positioned. Selectively extending through base 150 and ejection plate 152 are ejector pins 154. Initially, the mixture 156 is deposited within frame 144 on top of ejection plate 152. Mixture 156 is then compressed between ejection plate 152 and a male die 158 so as to form mixture 156 into the configuration of channel member 100. Male die 158 includes an elongated ridge 160 having opposing sides 162 and 164 that outwardly slope to corresponding flat shoulders 166 and 168. As a result of sides 162 and 164 of ridge 160 being outwardly sloping, mixture 156 is compressed between sides 162 and 164 of male die 158 and sides 146 and 148 of surrounding frame 144.

In one embodiment, the resin selected is heat activated. In this embodiment, mold 136 can be heated to a temperature in a range between about 175° to about 400° with about 250° to about 325° being more preferred. Mold 136 can be preheated in an oven or can be continually heated such as through electrical heating elements or through heated fluid channels. Other resins may not require heat for setting. Mixture 156 is typically compressed within mold 136 at a pressure in a range between about 100 tons to about 600 tons with about 250 tons to about 350 tons being more preferred. The pressure is maintained until mixture 156 sets, thereby forming channel member 100. The time and pressure that mold 136 is biased against mixture 156 depends on several factors such as the size of the member, the resin used, and the temperature of mold 136.

Once male die 158 is lifted, one or more ejector pins 154 are used to eject channel member 100 from mold 136. Since side walls 146 and 148 are disposed in parallel alignment, in one embodiment removal of channel member 100 from frame 144 requires one or both of side wall 146 and 148 to be retracted or pulled back from channel member 100. There are of course a variety of different mold configurations that can be used. It is also appreciated that those skilled in the art will implement the necessary vent holes, ejector pins, and releasing agents. Other releasing techniques can also be utilized as long as the sides of channel member 100 remain parallel.

The removed channel member 100 is then allowed to slowly cool until there is sufficient structural integrity to cut channel member 100 into desired lengths. In one embodiment, mold 136 is approximately 11 feet long, thereby allowing channel member 100 to be selectively cut into several popular lengths. In other embodiments, mold 136 can be the desired length for the final channel member 100.

Although not enjoying the benefits of the integrally formed channel member 100, it will be appreciated that the non-wood organic fiber/resin composite structural material may also be used to form traditional structural members such as 2×4 studs or members having the configuration necessary to form channel member 50 as previously discussed. By utilizing the teachings of the present invention to form the standard structural members, channel member 50 may be assembled utilizing a jig to assure the accuracy of the joining or may be assembled on site. If the members are assembled on site, the benefits of one-piece construction of factory assembly will be obviated, however, the consistency of the manufacture of the piece will allow for more consistent assembly due to the absence of knots and. other irregularities in the materia. Furthermore, the use of organic fiber composite products will still benefit the environment by diminishing the use of our wood resources.

Whether the elements are created using traditional modular sizes or through the one-piece techniques set forth previously, the structural members may then be stacked and shipped to the building site and incorporated into the structure. Because of the strength that may be designed into these elements, they may be used for residential or commercial construction. It will be appreciated that by providing molds of different shapes, channel members can be formed having desired mechanical properties. Furthermore, members other than channel members may be created. For example, trusses, arch ways, frames, furniture, or any other application in which wood has traditionally been used may be replicated using the instant invention.

Set forth below are a series of hypothetical examples of compositions that can be used in the above process for manufacturing the inventive channel member. It is appreciated that the examples are merely illustrative and are in no way intended to be limiting.

EXAMPLE 1.

A composition for use in molding a channel member is prepared by mixing a ratio of 96% by volume of straw from wheat with 4% by volume of MDI resin.

EXAMPLE 2.

A composition for use in molding a channel member is prepared by mixing a ratio of 95% by volume of straw from oat with 5% by volume of MDI resin.

EXAMPLE 3.

A composition for use in molding a channel member is prepared by mixing a ratio of 90% by volume of straw from barley with 10% by volume of MDI resin.

EXAMPLE 4.

A composition for use in molding a channel member is prepared by mixing a ratio of 93% by volume of straw from wheat, 3% by volume of fiberglass fibers, and 4% by volume of MDI resin.

EXAMPLE 5.

A composition for use in molding a channel member is prepared by mixing a ratio of 48% by volume of straw from wheat, 48% of alfalfa hay, and 4% by volume of MDI resin.

EXAMPLE 6.

A composition for use in molding a channel member is prepared by mixing a ratio of 48% by volume of straw from wheat, 48% of corn stalk fiber, and 4% by volume of MDI resin.

EXAMPLES 7–12.

Compositions are prepared for use in molding a channel member as set forth in Examples 1–6 except that the MDI resin is replaced with uria formaldehyde.

Figure 13:
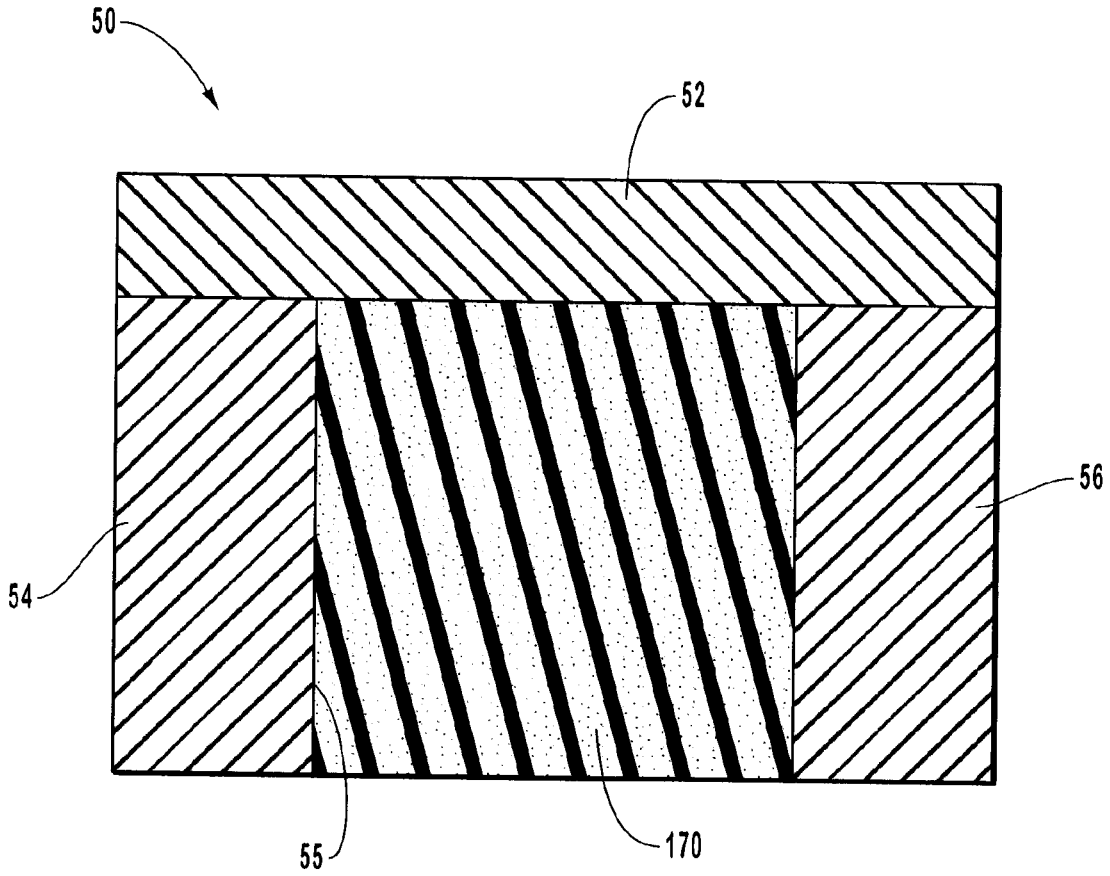
FIG. 13 is a cross sectional top view of the channel member shown in FIG. 4 wherein the channel thereof is filled with an insulating material.

In yet another embodiment, as depicted in FIG. 13, once a channel member is formed, such as channel member 50, an insulating material 170 can be disposed within channel 55 thereof. An example of insulating material 170 includes polyurethane foam insulate which can be sprayed into channel 55. Other insulating materials 170 include fiberglass insulation, such as Certainteed Insulsafe III or IV, and cellulose insulation. In one embodiment, the fiberglass and/or cellulose is first mixed with an adhesive, such as a latex based glue, and then filled into channel 55 where the adhesive is allowed to set. Insulation material 170 can also be filled into channel 118 of channel member 100 or within the channel of any other configured channel member.

What is claimed:

1. A channel member for use in framing a corner at intersecting walls of a structure, the channel member comprising an elongated body having:

a back wall having a substantially planer front face and an opposing back face each extending between opposing side faces, the front face having a width extending between the opposing side faces in a range from 5 inches to 7 inches, the width being substantially constant along the length of the body;

a first rail projecting from the back face of the back wall to an exposed end face; and a second rail projecting from the back face of the back wall to an exposed end face, the second rail being disposed at a spaced apart location from the first rail such that the body has a substantially U-shaped transverse cross section, the body having a thickness in a range from 3.25 inches to 3.75 inches extending between the front face of the back wall and the end face of either the first rail or the second rail, the thickness being substantially constant along the length of the body, the body being integrally formed as a discrete unit comprised of a binder and between about 60% to about 98% by volume organic non-wood fibers.

2. A channel member as recited in claim 1, wherein the first rail, second rail, and back wall bound a channel longitudinally extending along the length of the body, the channel being substantially filled with an insulting foam.

3. A channel member as recited in claim 1, wherein the organic non-wood fibers comprise straw, hay, corn stalk, or mixtures thereof.

4. A channel member as recited in claim 1, wherein the body is further comprised of at least synthetic fibers or wood fibers.

5. A channel member as recited in claim 1, wherein the binder comprises isocyanate, light gluten foam glue, or uria formaldehyde.

6. A channel member for use in framing a corner at intersecting walls of a structure, the channel member comprising an elongated body having:

a back wall having a substantially planer front face and an opposing back face each extending between opposing side faces, the front face having a width extending between the opposing side faces in a range from 7 inches to 9 inches, the width being substantially constant along the length of the body;

a first rail projecting from the back face of the back wall to an exposed end face; and a second rail projecting from the back face of the back wall to an exposed end face, the second rail being disposed at a spaced apart location from the first rail such that the body has a substantially U-shaped transverse cross section, the body having a thickness in a range from 5.25 inches to 5.75 inches extending between the front face of the back wall and the end face of either the first rail or the second rail, the thickness being substantially constant along the length of the body, the body being integrally formed as a discrete unit comprised of a binder and between about 60% to about 98% by volume organic non-wood fibers.

7. A channel member as recited in claim 6, wherein the first rail, second rail, and back wall bound a channel longitudinally extending along the length of the body, the channel being substantially filled with an insulting foam.

8. A channel member as recited in claim 6, wherein the organic non-wood fibers comprise straw, hay, corn stalk, or mixtures thereof.

9. A channel member as recited in claim 6, wherein the body is further comprised of at least synthetic fibers or wood fibers.

10. A channel member as recited in claim 6, wherein the binder comprises isocyanate, light gluten foam glue,or uria formaldehyde.

* * * * *

UNITED STATES PATENT AND TRADEMARK OFFICE

CERTIFICATE OF CORRECTION

PATENT NO. : 6,405,507 B1 
DATED : June 18, 2002
INVENTOR(S) : Edward "L" Milton and Floyd Nelson Milton It is certified that error appears in the above-identified patent and that said Letters Patent is hereby corrected as shown below:

Column 1,
Line 7, after "which" delete hyphen
Line 8, before "used" change "are-typical" to -- are typical --
Line 16, after "whereas" change "hemlock-and-other" to -- hemlock and other --
Line 36, before "at the intersection" change "position" to -- positioned --
Line 38, before "channel" change "2x4's" to -- 2x4s --

Column 2,
Line 16, before "are often warped" change "2x4's" to -- 2x4s --
Line 27, after "conventional" change "2x4's" to -- 2x4s --
Line 29, before "produces" change "2x4's" to -- 2x4s --
Line 29, after "most" change "situation," to -- situations --

Column 3,
Line 14, before "used" change "bet" to -- be --
Line 62, before "depict" change "drawing" to -- drawings --

Column 4,
Line 5, after "member" change "show" to -- shown --

Column 5,
Line 51, after "lumber" insert a comma

Column 6,
Line 22, before "at a wall" change "comer" to -- corner --
Line 40, before "configuration" change "comer" to -- corner --
Line 44, after "wall 17" change "in" to -- is --
Line 50, before "80 is used" change "comer" to -- corner --
Line 62, after "inside" change "comers" to -- corners --

Column 7,
Line 13, after "substantially" change "planer" to -- planar --

UNITED STATES PATENT AND TRADEMARK OFFICE

CERTIFICATE OF CORRECTION

PATENT NO. : 6,405,507 B1 
DATED : June 18, 2002
INVENTOR(S) : Edward "L" Milton and Floyd Nelson Milton It is certified that error appears in the above-identified patent and that said Letters Patent is hereby corrected as shown below:

Column 9,
Line 21, after "knots and" delete the period
Line 22, before "Furthermore" change "materia." to -- material. --

Column 10,
Lines 30 and 66, after "substantially" change "planer" to -- planar --

Signed and Sealed this

Eleventh Day of March, 2003

JAMES E. ROGAN
*Director of the United States Patent and Trademark Office*